United States Patent [19]

Christini et al.

[11] Patent Number: 4,780,186

[45] Date of Patent: Oct. 25, 1988

[54] LITHIUM TRANSPORT CELL PROCESS

[75] Inventors: Roy A. Christini; Eric L. Clark, both of Washington Township, Westmoreland County; Kenneth A. Bowman, Kiski Township, Westmoreland County, all of Pa.

[73] Assignee: Aluminum Company of America, Pittsburgh, Pa.

[21] Appl. No.: 64,709

[22] Filed: Jun. 22, 1987

[51] Int. Cl.[4] ..... C25C 3/02

[52] U.S. Cl. ..... 204/68

[58] Field of Search ..... 204/59 AM, 68, 130, 204/67, 60

[56] References Cited

U.S. PATENT DOCUMENTS

| | | | |
|---|---|---|---|
| 1,534,315 | 4/1925 | Hoopes | 204/67 |
| 1,534,316 | 4/1925 | Hoopes et al. | 204/67 |
| 1,534,317 | 4/1925 | Hoopes et al. | 204/67 |
| 1,534,318 | 4/1925 | Hoopes et al. | 204/67 |
| 1,534,319 | 4/1925 | Hoopes et al. | 204/67 |
| 1,534,320 | 4/1925 | Hoopes | 204/67 |
| 1,534,321 | 4/1925 | Hoopes | 204/67 |
| 1,534,322 | 4/1925 | Hoopes et al. | 204/67 |
| 1,535,458 | 4/1925 | Frary | 204/67 |
| 1,562,090 | 11/1925 | Hoopes | 204/67 |
| 3,904,494 | 9/1975 | Jacobs et al. | 204/67 |
| 3,962,064 | 6/1976 | Brut et al. | 204/245 |
| 4,156,635 | 5/1979 | Cooper et al. | 204/68 |
| 4,183,745 | 1/1980 | Tsumura | 75/68 R |
| 4,209,496 | 6/1980 | Carpenter et al. | 423/210 |
| 4,248,630 | 2/1981 | Balmuth | 75/135 |
| 4,385,964 | 5/1983 | Johnson et al. | 203/50 |
| 4,390,364 | 6/1983 | Yu | 75/67 A |
| 4,411,747 | 10/1983 | Dawless et al. | 204/67 |
| 4,430,174 | 2/1984 | Tsumura | 204/67 |
| 4,436,627 | 3/1984 | McMonigle | 210/695 |
| 4,455,202 | 6/1984 | Damoa et al. | 204/68 |
| 4,456,479 | 6/1984 | Harris et al. | 75/63 |

FOREIGN PATENT DOCUMENTS

| | | |
|---|---|---|
| 2933065 | 1/1981 | Fed. Rep. of Germany . |
| 54-043811 | 4/1979 | Japan . |

OTHER PUBLICATIONS

Junius David Edwards et al, "The Aluminum Industry, Aluminum and Its Production," McGraw-Hill Book Company, Inc., New York, 1930, pp. 322-327.

Basant L. Tiwari et al., "Electrolytic Extraction of Magnesium from Commercial Aluminum Alloy Scrap," *Physical Chemistry of Extractive Metallurgy,* AIME, New York, Feb. 1985, pp. 147-164.

Basant L. Tiwari, "Demagging Processes for Aluminum Alloy Scrap," *Journal of Metals,* Jul. 1982, pp. 54-58.

M. Schofield, "Developments in Lithium Technology,'-'*Metallurgia,* Dec. 1964, pp. 278-280.

Joseph S. Smatko, "The Lithium Electrolytic Cell," Published by the Office of Military Government for Germany, Apr. 1, 1946.

R. R. Rogers et al, "The Production of Lithium Metal,"*The Canadian Mining and Metallurgical Bulletin,* Nov. 1948, pp. 623-628.

Richard Bauer, "Lithium-Electrochemical Aspects," *Chemi-Ing. Techn.,* 44, (4), 1972, pp. 147-151.

*Primary Examiner*—R. L. Andrews

*Attorney, Agent, or Firm*—Douglas G. Glantz

[57] ABSTRACT

The present invention provides a process for recovering lithium from an aluminum-lithium alloy scrap including heating a lithium chloride-potassium chloride-lithium fluoride salt mixture in a separate bath melter vessel to form a molten salt bath reservoir; fluxing the molten salt with chlorine or hydrogen chloride gas to remove moisture; drying the aluminum-lithium scrap; heating the dried aluminum-lithium alloy scrap to form a molten reservoir of aluminum-lithium alloy; feeding low moisture molten salt and aluminum-lithium alloy to a three-layered electrolysis cell comprising a most dense lowest layer of molten aluminum-lithium alloy, a middle layer of molten salt electrolyte, and an uppermost layer of molten lithium; passing direct current through the cell with the aluminum-lithium alloy anodic; reducing lithium ions to lithium metal at a cathode suspended in the molten salt electrolyte; and removing lithium from said uppermost layer in said three-layered electrolysis cell.

13 Claims, 1 Drawing Sheet

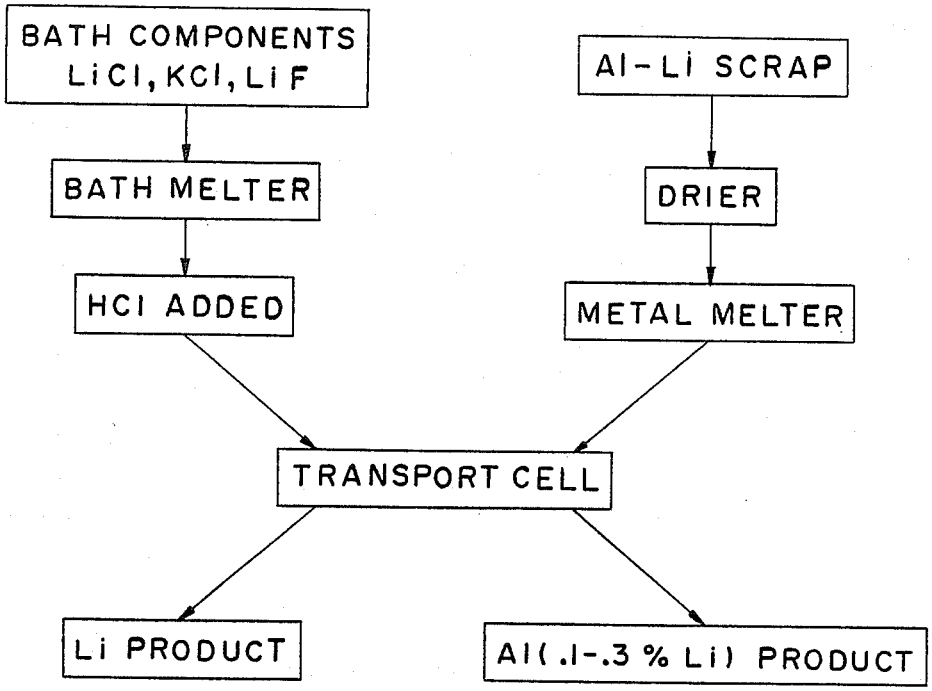
FIG. 1- PROCESS FLOW DIAGRAM
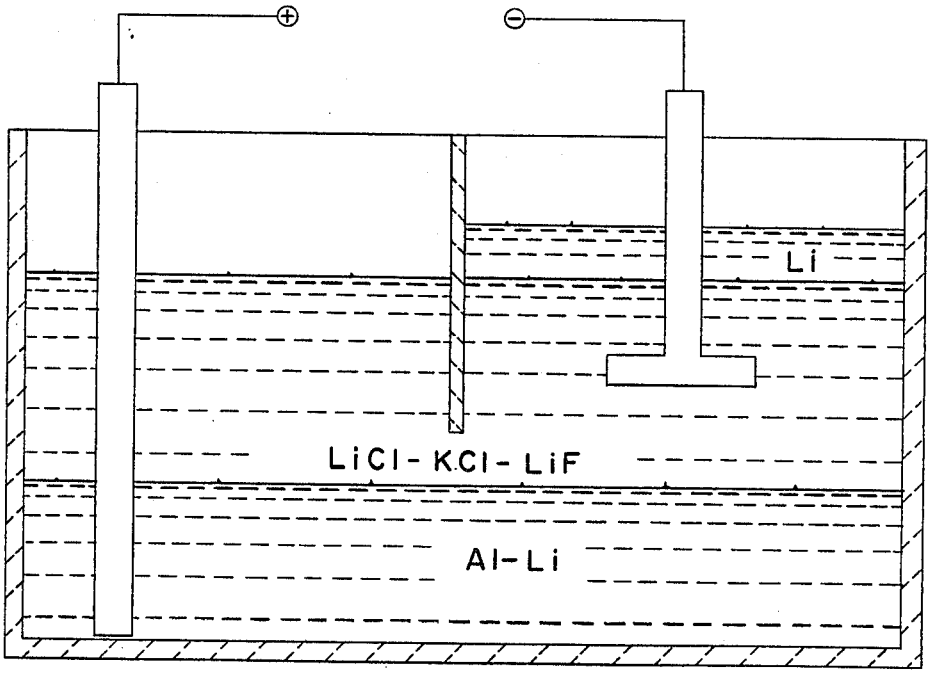
FIG. 2-THREE LAYERED CELL

LITHIUM TRANSPORT CELL PROCESS

BACKGROUND OF THE INVENTION

1. Technical Field

This invention relates to a process for producing lithium from recycled lithium-containing alloys such as aluminum-lithium alloy scrap.

2. Background of the Prior Art

Lithium is the lightest among the elements that are solid under normal conditions, having a specific weight of about 0.59 g/cm$^3$. This light metal floats on water and oil and also on many molten salts. Lithium was produced for the first time by the electrolysis of lithium chloride. Other starting materials such as lithium bromide or lithium hydroxide have been found to be less desirable in the production of lithium metal for reasons that they are more expensive and that secondary reactions produce low current efficiencies. Lower operating temperatures in the production of lithium from lithium chloride can be achieved by adding other compounds to form low melting point eutectics. For example, a low melting point eutectic is achieved by formulating a composition of LiCl/KCl of about 57/43 mol %. Even lower melting point eutectics are available from compositions such as LiCl/$NaH_4Cl$ and several LiCl/$LiNO_3$ compositions.

In the production of lithium electrolytically from lithium chloride, potassium chloride has been added to the electrolyte melt because of a decomposition potential higher than that for lithium chloride. Decomposition potentials at about 450° C. are 3.68V for LiCl, 3.57V for NaCl, and 3.81V for KCl. Decomposition potentials indicate that potassium will not be reduced as readily as lithium or sodium. Sodium, on the other hand, has a decomposition potential which indicates that sodium is reduced preferentially to lithium. For this reason, sodium contaminants should be eliminated before attempting the production of pure lithium from lithium chloride.

As early as the earliest patents for the production of aluminum electrolytically, lithium compounds were mentioned for use in aluminum electrolysis, but financial aspects limited the universal realization of this proposal until only recently. Lithium fluoride can be used, but lithium carbonate is more economical and reacts under the prevailing conditions with aluminum fluoride to form lithium fluoride and aluminum oxide. The main advantage of lithium addition in aluminum electrolysis is attributable to a reduction in the liquidus temperature of the electrolyte and reductions of melt density and viscosity. A drawback, however, is a reduced solubility for the aluminum oxide. Nevertheless, this drawback can be compensated by reduced calcium fluoride content. Lower temperatures in the electrolysis eventually would freeze the bath, but this can be counteracted by increasing the cell current or by increasing the anode-cathode distance. Lithium compounds have been added to aluminum electrolysis in the amounts of 3 to 5% as lithium fluoride to reduce costs by lower energy consumption by about 3%, to reduce carbon consumption by about 2%, to reduce bath addition by up to 4%, and to reduce fluoride emissions by up to about 50%.

Lithium metal can be produced directly from ore by heating together a mixture of spodumene, lime, and aluminum or silicon to a temperature above about 100° C. at a pressure of 25 microns to produce a lithium-magnesium alloy containing 85–90% lithium. The technical literature has mentioned a method for producing lithium metal by an electrolysis of a fused mixture of lithium and potassium chloride. The technical literature also mentions that electrolysis is employed to form alloys of lithium with metals of low melting points, such as lead, tin, or zinc, wherein the molten heavy metal is used as the cathode and the lithium is electrodeposited from a fused salt mixture containing lithium chloride.

The electrolytic production of lithium alloys has been investigated for alloys of lead, zinc, aluminum, magnesium, and copper-aluminum from starting materials consisting of a fused mixture of equal weights of lithium chloride and potassium chloride. Cathodes of the various alloying metals in the molten state were used.

Pure lithium has been obtained from lead-lithium and copper-aluminum-lithium alloys by distillation at low pressures. Lithium metal has been produced from lithium chloride using electrolytes of lithium chloride and potassium chloride, and, optionally, lithium bromide at a current efficiency of over 90% and a metal yield on the basis of lithium chloride input of 95% in a sodium type of cell. The sodium type of cell has anodes of graphite and cathodes of steel. The cell is heated externally by gas or oil, and the salt mixture is fused between anodes of graphite and cathodes of steel. Current is applied and molten lithium metal is formed. Chlorine is formed at the anode and is vented and recovered from the cell, five pounds of chlorine for each pound of lithium metal produced.

U.S. Pat. No. 3,962,064 discloses lithium formed on a cathode and collected in an electrolytic tank of stainless steel having a solid cathode and anode. An inert gas is introduced into a discharge compartment, and lithium is transferred to that chamber for casting into ingots under inert atmosphere.

Japanese Patent Disclosure No. 79,043,811 discloses a production method for metallic lithium in which mixed salts consisting of 42–52 wt % lithium chloride and 58–48 wt % potassium chloride are electrolyzed in the molten state. The electrolysis is carried out in the molten state by heating the mixed salts at 380°–500° C. at a voltage of 4–12V and a current density of 50–300 A/dm$^2$. A lithium electroconductive solid electrolyte such as a lithium sulfate, a lithium-beta-alumina, or a lithium alumina silicate are used as a diaphragm for partitioning the cathode and anode chambers used in the electrolysis. When the content of lithium chloride is less than 42 wt %, the ratio of metallic lithium redissolved is markedly increased and electrical resistance is also increased. When the content of lithium chloride exceeds 52 wt %, these same effects occur. Electrodes used in the electrolysis are graphite or carbon for the anode and stainless steel for the cathode.

U.S. Pat. No. 4,455,202 discloses a process for producing lithium by the electroreduction of a lithium compound dispersed in a fused salt electrolyte and deposition of the electroreduced lithium in a liquid metal cathode from which lithium is recovered. A fused salt electrolyte includes a lithium compound and at least one of the following elements of the Periodic Table including Group IIIA, such as boron; Group IVA, such as carbon; Group VA, such as nitrogen; and Group VIA, such as oxygen. The patent discloses the electroreducing of lithium oxide dispersed in such an electrolyte of fused lithium salts and alloying the electroreduced lithium with a liquid metal cathode. Suitable electrolytes are disclosed to be chalcogenides such as $Li_2O$, $K_2O$, CaS, $Na_2S$, $K_2Se$, CaSe, or BaTe; fluorides such as LiF, NaF, KF, $CaF_2$, $BaF_2$, or $SrF_2$; hydroxides such as LiOH, NaOH, KOH, or $Ca(OH)_2$; sulfates such as $Li_2SO_4$, $Na_2SO_4$, $K_2SO_4$, or $SrSO_4$; nitrates such as $LiNO_3$, $NaNO_3$, $KNO_3$, or $Ca(NO_3)_2$; carbonates such as $Li_2CO_3$, $Na_2CO_3$, $K_2CO_3$, $CaCO_3$, or $SrCO_3$; and mixtures of all the preceding.

The Hoopes cell process includes feeding an impure aluminum or aluminum alloy in a molten state as an anode in contact with a superimposed bath or electrolyte preferably containing one or more fused fluorides with or without the addition of chlorides, the pure aluminum being deposited on the cathode of molten aluminum preferably floating on the bath or electrolyte. The Hoopes cell is disclosed in U.S. Pat. Nos. 1,534,317 and 1,534,318. The preferred electrolyte or bath in the Hoopes cell contains 25–30% aluminum fluoride, 30–38% barium fluoride, 25–30% sodium fluoride, 0.5–3% alumina, and 2% calcium and magnesium fluorides present as impurities.

Aluminum-lithium alloys currently are receiving more attention as candidates for use in structural metal applications in the aerospace industry. Aluminum-lithium alloys offer the advantage of lighter weight and high structural integrity, making these alloys attractive to the aerospace industry for saving fuel.

Large quantities of scrap are generated for every pound of metal used in an aircraft. It is desirable to recycle most of this scrap into ingot form for further processing and application in new products, such as aircraft plate or sheet or aircraft extrusions. However, since several different alloys are used, mixed scrap may not be recyclable in whole or even in part by melting the scrap and forming the ingot directly. If scrap cannot be recycled into new aluminum-lithium ingot, some method must be found to remove and recover the lithium from the scrap. Processes that lead to the production of both lithium and lithium-free aluminum are desirable.

The electrolytic processes described above have one or more drawbacks or disadvantages which have been found to be undesirable in the pursuit of reclaiming lithium from aluminum-lithium alloy scrap.

It is an object of the present invention to provide a process for recovering the lithium content from recycled aluminum-lithium alloy scrap.

It is a further object of the present invention to provide a process for recovering lithium in a three-layered lithium transport cell.

It is yet another object of the present invention to provide a process for the recovery of lithium from aluminum-lithium alloy scrap in a lithium transport cell operating at predetermined process parameters of bath composition and temperature for improved process efficiency.

These and other objects of the present invention will become apparent from the detailed description of the invention as follows.

SUMMARY OF THE INVENTION

The present invention provides a process for recovering lithium from an aluminum-lithium alloy scrap including heating a lithium chloride-potassium chloride-lithium fluoride salt mixture in a separate bath melter vessel to form a molten salt bath reservoir; fluxing the molten salt with chlorine or hydrogen chloride gas to remove moisture; drying the aluminum-lithium scrap; heating the dried aluminum-lithium alloy scrap to form a molten reservoir of aluminum-lithium alloy; feeding low moisture molten salt and aluminum-lithium alloy to a three-layered electrolysis cell comprising a most dense lowest layer of molten aluminum-lithium alloy, a middle layer of molten salt electrolyte, and an uppermost layer of molten lithium; passing direct current through the cell with the aluminum-lithium alloy anodic; reducing lithium ions to lithium metal at a cathode suspended in the molten salt electrolyte; and removing lithium from said uppermost layer in said three-layered electrolysis cell.

BRIEF DESCRIPTION OF THE DRAWINGS

FIG. 1 is a process flow diagram outlining the sequence of steps necessary to perform the process of the present invention.

FIG. 2 illustrates a schematic apparatus for carrying out the process of the present invention.

DETAILED DESCRIPTION

The process of the present invention employs a lithium transport cell set up as a three-layered electrolytic cell. The lowest layer of the three-layered cell is formed by an aluminum-lithium alloy layer having a density of about 2.1 g/cc. As will be seen from the following description, this lowest layer of aluminum-lithium alloy will have the highest density of the three layers in the three-layered electrolytic cell. This lowest layer of aluminum-lithium alloy is made anodic. An intermediate salt bath layer of lithium chloride or lithium chloride and potassium chloride or lithium chloride, potassium chloride and lithium fluoride has a density of about 1.5 g/cc. An uppermost lithium layer has the lowest density of the three layers in the cell at about 0.5 g/cc, and the uppermost layer of lithium thereby floats on the intermediate layer of salt bath. Lithium is produced at a cathode which is submerged in the salt bath.

The process of the present invention is operated at temperatures above about 660° C., preferably above about 680° C., and more preferably at a minimum temperature of about 700° C. Lithium melts at about 180° C., lithium chloride at about 608° C., lithium chloride-potassium chloride-lithium fluoride compositions rich in lithium chloride at about 350°–608° C., and aluminum-lithium alloys at about 630°–660° C. The process of the present invention is operated to have all three phases in the three-layered electrolytic cell liquid at the same time. For this reason, the cell must be operated above the temperature of about 660° C.

When direct current is applied to flow through the three-layered cell of the present invention, lithium is oxidized at the alloy-bath interface. Simultaneously, other lithium ions are reduced to lithium metal at the cathode submerged in the salt bath. Impurities present in the alloy or in the bath will determine the quality of the lithium produced. At the lower alloy-bath interface, the sequence of ions oxidized is potassium, lithium, calcium, sodium, magnesium, and aluminum, in that order. However, the lithium, calcium, and sodium ions are oxidized approximately at the same rate. For this reason, any potassium, calcium, or sodium impurities oxidize into the bath under the same conditions as lithium. Levels of calcium and sodium in the alloy must be held to insignificant levels. As noted, neither magnesium nor aluminum oxidize before lithium. For this reason, lithium removal without magnesium or aluminum contamination can occur. Magnesium and aluminum only begin to oxidize under limiting conditions, i.e., when the lithium in the alloy has been reduced below some threshold minimum and when the current density at the alloy-bath interface is so high that ions are oxidized indiscriminately. Close monitoring of process control is important to achieve a high lithium product purity.

Pure lithium can only be produced at the cathode as long as two important criteria are controlled. The lithium in the aluminum-lithium alloy cannot be lowered to less than 0.1–0.3 wt % Li or oxidation of aluminum and/or magnesium will start. Once the bath is contaminated with aluminum or magnesium, these elements will be reduced preferentially at the cathode. Thus, pure lithium cannot be produced.

The second criteria is anode current density. The anode current density must be controlled at less than about 6 amps/square inch. At anode current densities greater than 6 amps/square inch, oxidation at the anode surface (aluminum-lithium alloy-bath interface) is indiscriminate. Aluminum and magnesium oxidize at rates comparable to lithium. The bath is again contaminated and pure lithium cannot be produced. The anode surface area is defined here as the total aluminum-lithium alloy-bath surface area.

At the cathode, the sequence of ions reduced is reversed since the reverse reaction of reduction is occurring. Any aluminum or magnesium in the bath is reduced to metal before lithium. Sodium and calcium would be reduced essentially simultaneously with lithium. On the other hand, potassium will not be reduced at all until the lithium in the bath has been essentially depleted.

In accordance with the present invention, bath composition must be controlled at specified concentrations of bath constituents. The bath composition is controlled not to contain any cation more easily reduced than lithium. For this reason, the bath composition is controlled not to contain aluminum chloride, magnesium chloride, sodium chloride, or calcium chloride. The bath composition contains lithium chloride, potassium chloride, and lithium fluoride, for reasons explained hereinbelow.

It has been found that the bath composition should be controlled to contain a composition of about 55–100 wt % lithium chloride, 0–45 wt % potassium chloride, and 0–10 wt % lithium fluoride. A more preferred composition comprises lithium chloride at 65–75 wt %, potassium chloride at 25–30 wt %, and lithium fluoride at 4–6 wt %. At preferred concentrations, lithium recovery has been found to be higher. The addition of 5–10 wt % lithium fluoride enhances aluminum-lithium and lithium coalescence, thus facilitating tapping the two liquid metals from the three-layered cell.

Two very distinct limits exist for the molten salt composition. High lithium chloride contents (>90 wt %) produce low lithium recoveries attributable to lithium metal dissolution in the bath. The cell can be operated but recoveries are less than optimum.

Low lithium chloride contents (<55 wt %) lead to destructive reactions between the molten salt and the graphite anode when direct current is applied. These destructive reactions do not occur at higher lithium chloride contents.

Bath composition control with respect to low sodium chloride content was also found to be critical for another reason. As mentioned above, sodium would be reduced essentially simultaneously with the lithium. Lithium contaminated with low levels of sodium was found to react with the air to produce lithium nitride instead of lithium oxide. Lithium nitride is a pyrophoric material and quite hazardous. It is, therefore, imperative to produce lithium with low levels of sodium, less than about 0.5%, and preferably less than 0.1%.

Storage of sodium contaminated lithium was almost impossible by reason of its tendency to produce lithium nitride. Pure lithium could be stored under dry argon for months with very little deterioration. Sodium contaminated lithium was sufficiently reactive that it would react with the small amounts of air in the container, create a vacuum and suck more air into the container. It was almost impossible to store sodium contaminated lithium.

The process of the present invention includes two preliminary processing steps to remove moisture from the molten salt and separately from the aluminum-lithium scrap. The preliminary moisture removal step for the molten salt involves reactive gas fluxing to remove water present as hydroxide ion. The separate preliminary moisture removal step for aluminum-lithium alloy preferably withdraws moisture to a level below about 0.1%. The process of the present invention incorporates the two preliminary moisture removal steps to avoid problems which occur in the form of the bath becoming very thick and foamy. In such a situation, sampling becomes very difficult, and lithium drops on the surface of the bath do not coalesce due to oxides in the bath that inhibit coalescence. In one aspect, the process of the present invention includes controlling the atmosphere above the lithium pool in the three-layered electrolytic cell such that moisture is prevented from entering the low moisture system.

EXAMPLE 1

An apparatus constructed as illustrated in FIG. 2 was used to remove lithium from an aluminum-lithium alloy in accordance with the process of the present invention.

In a MgO crucible with a MgO upper liner, 3,800 grams of a salt mixture containing 70% LiCl, 25% KCl, and 5% LiF were heated to 700° C overnight. An additional 700 grams of salt was added to adjust the bath height. The molten bath was fluxed with HCl gas for one hour to remove all traces of water or hydroxide. 5,445 grams of scrap Al-Li alloy were added to the crucible. A graphite anode rod was lowered into the Al-Li alloy. A stainless steel cathode in a rod and plate assembly was lowered into position. Direct current of 150 A was passed through the cell for two hours. Samples were taken every thirty minutes from both bath and lithium and at start and finish from the alloy. The anode current density was 3.8 A/in$^2$, and the cathode current density was 21 A/in$^2$.

Anode current efficiency, defined as Li removed from alloy/theoretical Li transported, was greater than 99%. Similarly, cathode current efficiency, defined as Li recovered/theoretical Li transported, was also greater than 99%. Li purity varied from 98.3% to 99.1% Li with Mg as the major impurity. Li in the alloy was successfully reduced from 1.86% to 0.32%. Operating parameters are summarized in Table I.

EXAMPLE 2

A similar apparatus was constructed and operated as described in Example 1 at a different bath composition. Bath composition was 45% LiCl, 50% KCl, and 5% LiF. The start-up and operating conditions were similar to Example 1. However, in this case, destructive reactions occurred between the molten salt and both the graphite anode and the graphite crucible outside the main crucible.

Anode current efficiency was somewhat lower at 86%, since Li was depleted from the aluminum alloy. Thus, some of the current was carried by Mg transport. Cathode current efficiency was 97%. Li purity was between 98.1% and 99.7%. Li in the alloy was reduced from 1.88% to 0.07%.

It was found that destructive reactions occur at high levels of KCl. Thus, bath with high levels of KCl should not be used.

EXAMPLE 3

Another apparatus was assembled with one change; an $Al_2O_3$ crucible was substituted for the main MgO crucible. The upper liner was not changed from a MgO tube.

The bath composition was 95% LiCl and 5% LiF. No KCl was used to determine whether a LiCl-LiF bath free from KCl could be used.

Start-up and operating conditions were very similar to Example 1. No destructive reactions occurred.

Anode current efficiency was low at 78%, due to the low levels of Li attained in the aluminum alloy. Cathode current efficiency was 99%. Li purity was between 98.3% and 99.3%. Li in the alloy was reduced from 1.91% to 0.01%.

No detrimental effects were apparent when using this bath containing only LiCl-LiF with no KCl.

EXAMPLE 4

A fourth apparatus was assembled identical to Example 3. The bath composition was 65% LiCl, 25% KCl, and 10% LiF. This composition was run to determine whether high levels of LiF could be run.

Start-up and operating conditions were identical to Example 3. No destructive reactions occurred.

Anode current efficiency was quite good at 92%. Cathode current efficiency was excellent at 98%. Li purities were very good between 98.8% and 99.0%. Li in the alloy was reduced from 2.13% to 0.03%.

No detrimental effects were apparent when using this bath containing higher levels of LiF.

TABLE I

| Bath Composition Effects | | | | |
|---|---|---|---|---|
| Example | 1 | 2 | 3 | 4 |
| Run | TC2 | TC4 | TC5 | TC6 |
| Bath Composition: | | | | |
| LiCl (%) | 70 | 45 | 95 | 65 |
| KCl (%) | 25 | 50 | 0 | 25 |
| LiF (%) | 5 | 5 | 5 | 10 |
| Bath wt (g) | 4500 | 5560 | 3800 | 3800 |
| Alloy wt (g) | 5421 | 5820 | 4945 | 4388 |
| Current (amps) | 150 | 150 | 150 | 150 |
| Time (hr) | 2 | 3 | 3 | 3 |
| Anode C.D. ($A/in^2$) | 3.8 | 3.6 | 4.2 | 4.3 |
| Cathode C.D. ($A/in^2$) | 21 | 21 | 21 | 21 |
| Anode Current Efficiency (%) | 99 | 86 | 78 | 92 |
| Cathode Current Efficiency (%) | 99 | 97 | 99 | 98 |
| Li Purity (%) | ~98 | ~98 | ~98 | ~99 |
| Initial Li in Al—Li (%) | 1.86 | 1.88 | 1.91 | 2.13 |
| Final Li in Al—Li (%) | 0.32 | 0.07 | 0.01 | 0.03 |

While the invention has been described in terms of preferred embodiments, the claims appended hereto are intended to encompass all embodiments which fall within the spirit of the invention.

What is claimed is:

1. A process for recovering lithium from an aluminum-lithium alloy scrap comprising:

(a) heating a lithium chloride-potassium chloride-lithium fluoride salt mixture in a bath melter vessel to form a molten salt bath reservoir;

(b) fluxing said molten salt with chlorine or hydrogen chloride gas to remove hydroxide ion;

(c) removing moisture from an aluminum-lithium alloy scrap by preheating to 110° C. to form a dried aluminum-lithium alloy scrap;

(d) heating said dried aluminum-lithium alloy scrap to form a molten reservoir of aluminum-lithium alloy;

(e) feeding low moisture molten salt and said molten reservoir of aluminum-lithium alloy to a three-layered electrolysis cell comprising a most dense lowest layer of molten aluminum-lithium alloy, a middle layer of molten salt electrolyte, and an uppermost layer of molten lithium;

(f) passing direct current through the three-layered cell such that said lowest layer acts as an aluminum-lithium alloy anode to oxidize lithium out of the alloy;

(g) reducing lithium ions to lithium metal at a cathode immersed in the molten salt electrolyte; and (h) removing lithium from said uppermost layer in said three-layered electrolysis cell.

2. The process as set forth in claim 1 wherein said dried aluminum-lithium alloy comprises aluminum-lithium alloy having less than about 0.1 wt % moisture.

3. The process as set forth in claim 2 further comprising controlling the atmosphere above said three-layered cell to prevent moisture from entering any of the three layers in said cell.

4. The process as set forth in claim 3 wherein said salt electrolyte has a composition comprising about 55–100 wt % LiCl, about 0–45 wt % KCl, and 0–10 wt % LiF.

5. The process as set forth in claim 3 wherein said lithium chloride concentration is about 65–75 wt %, said potassium chloride concentration comprises about 25–30 wt %, and said lithium fluoride comprises about 4–6 wt %.

6. The process as set forth in claim 3 wherein said lithium chloride concentration is about 70 wt % and said potassium chloride concentration is about 25 wt %, and said lithium fluoride concentration is about 5 wt %.

7. The process as set forth in claim 4 comprising electrolytically oxidizing lithium in the lowest layer at a temperature above about 660° C.

8. The process as set forth in claim 4 comprising electrolytically oxidizing lithium in the lowest layer at a temperature at a minimum of 700° C.

9. The process as set forth in claim 8 wherein said salt electrolyte composition contains less than about 0.02 wt % sodium.

10. The process as set forth in claim 9 wherein said salt electrolyte composition contains less than about 0.02 wt % calcium.

11. The process as set forth in claim 10 wherein the lithium content of the aluminum-lithium is controlled not to fall below about 0.1 wt % lithium.

12. The process as set forth in claim 10 wherein the lithium content of the depleted aluminum-lithium alloy is controlled not to fall below about 0.3 wt % lithium.

13. The process as set forth in claim 11 wherein the current density at the anode does not exceed 6 amps/-square inch.

* * * * *